United States Patent [19]

Sobson

[11] 4,130,214

[45] Dec. 19, 1978

[54] PORTABLE CONTAINER HAVING SERVICE TOWER

[76] Inventor: Ted P. Sobson, 22624 Lakecrest St., St. Clair Shores, Mich. 48081

[21] Appl. No.: 858,621

[22] Filed: Dec. 8, 1977

[51] Int. Cl.[2] ..... B65D 25/00; A47F 5/00; A47G 29/00

[52] U.S. Cl. ..... 220/85 R; 211/86; 15/264; 248/121

[58] Field of Search ..... 220/85 R, 85 D, 85 H, 220/18, 94 R, 96, 90; 248/79, 121, 127, 146, 154; 211/71, 74, 86, 24; 294/172, 2, 23; 15/264

[56] References Cited

U.S. PATENT DOCUMENTS

| | | | |
|---|---|---|---|
| 989,778 | 4/1911 | Fockhart | 86/46 |
| 1,409,255 | 3/1922 | Smith | 211/71 |
| 1,666,293 | 4/1928 | Lorton | 211/86 |
| 1,758,131 | 5/1930 | Stirdivant | 248/80 |
| 1,860,655 | 5/1932 | Chismadia | 15/264 |
| 1,865,757 | 7/1932 | Honsowetz | 211/172 |
| 2,498,511 | 2/1950 | Smith | 211/86 X |
| 3,035,708 | 5/1962 | Freeman | 211/86 X |
| 3,756,451 | 9/1973 | Popeil | 220/94 R X |

*Primary Examiner*—William Price
*Assistant Examiner*—Steven M. Pollard
*Attorney, Agent, or Firm*—Basile and Weintraub

[57] ABSTRACT

A portable container has an upright service tower in the form of an elongated support post with one end secured to the bottom of a water-filled container adjacent its side wall, while an intermediate section is secured to the upper side wall of the container. A suitable spacer is disposed between the container side wall and the service tower so as to slightly incline the support post toward the center of the container to thereby stabilize both the support post and the container. A handle pivotally carried by the container is adapted to snap-lockingly engage the post to securely attach the container to the support post. The post has a plurality of means for carrying articles, such as brushes, bottles, a hose, soaps and the like.

1 Claim, 4 Drawing Figures

PORTABLE CONTAINER HAVING SERVICE TOWER

BACKGROUND OF THE INVENTION

I. Field of the Invention

The present invention relates to an apparatus for supporting various articles used in conjunction with the washing and cleaning of automobiles, windows and the like and, in particular, to a fluid-carrying container having a service tower attached thereto for supporting a multiple of articles.

II. Description of the Prior Art

It is customary in the washing of various household items including exterior portions of windows, aluminum siding, gutters and other external portions of a home, as well as in the washing of a vehicle, such as an automobile, to employ a variety of cleaning articles. These articles include a source of cleaning fluid usually in the form of soapy water, ancillary cleansing powders, sponges, brushes and a source of a rinsing water, such as a conventional garden hose. It is customary that each of these items is carried individually to the scene of the cleaning operation and is usually positioned in an area which is convenient for the user. As the washing operation progresses, it is necessary that the articles be moved from position to position so as to be conveniently located. It would be desirable to provide a device which would facilitate the carrying of the cleaning fluid and other articles associated with such cleaning operations in a manner which is convenient, simple and economical.

A study of the prior art reveals that a number of attempts have been made for providing units, devices and apparatuses which relate generally to applicant's invention. These attempts include the devices disclosed in U.S. Pat. Nos. 989,773; 1,409,255; 1,666,293; 1,758,131; 1,865,757; and 3,035,708. Of particular interest is U.S. Pat. No. 989,773 which discloses an apparatus that represents the closest known prior art to applicant. This patent broadly discloses a post which is mounted to the edge of a bathtub. The post is provided with a plurality of receptacles, hooks, arms and the like for storing equipment used by a bather, such as towels, soaps, sponges and brushes. U.S. Pat. No. 1,409,255 discloses a stand which supports a bowl and, in turn, a support structure which mounts a cup, dish rack, post and hooks for the support of brushes and towels. U.S. Pat. No. 1,758,131 is of interest in that it discloses a stationary service tower which is provided with both a water hose and an air hose and means for conveniently using the same. The remaining aforementioned patents disclose various apparatuses which consist of a post provided with a plurality of arms or similar structure for the support of towels, cups and the like including cooking apparatuses and related items.

While each of the patents discloses an article which broadly relates to applicant's invention, they fail to disclose the novel and unique structural aspects of applicant's invention as described and claimed hereinafter.

III. Prior Art Statement

In the opinion of applicant and applicant's attorney the aforementioned prior art constitutes the closest prior art of which applicant and applicant's attorney are aware.

SUMMARY OF THE INVENTION

The present invention, which will be described subsequently in greater detail, comprises a portable, fluid-carrying container having a service tower attached thereto. The service tower is in the form of a support post attached to the container in such a manner that it is in an upright position and is inclined slightly toward the center of the container to provide stability for both the container and the support post. Fastening means carried by the support post snap-lockingly engage the handle of the container to secure the container to the post. The post is provided with a plurality of holding means for mounting and storing articles utilized in a cleaning operation, such as towels, brushes, soap, cleaning fluids, sponges and the like.

It is therefore a primary object of the present invention to provide a portable, fluid-carrying container having a service tower for supporting a plurality of articles of manufacture used in conjunction with a cleaning operation.

It is a further object of the present invention to provide a container and service tower of the type described which is of a simple design, easy to manufacture and reliable in use.

Other objects, advantages and applications of the present invention will become apparent to those skilled in the art of such containers and service towers when the accompanying description of one example of the best modes contemplated for practicing the invention is read in conjunction with the accompanying drawings.

BRIEF DESCRIPTION OF THE DRAWINGS

The description herein makes reference to the accompanying drawings wherein like components are referred to by the same numerals, and wherein.

DESCRIPTION OF THE PREFERRED EMBODIMENT

Figure 1:
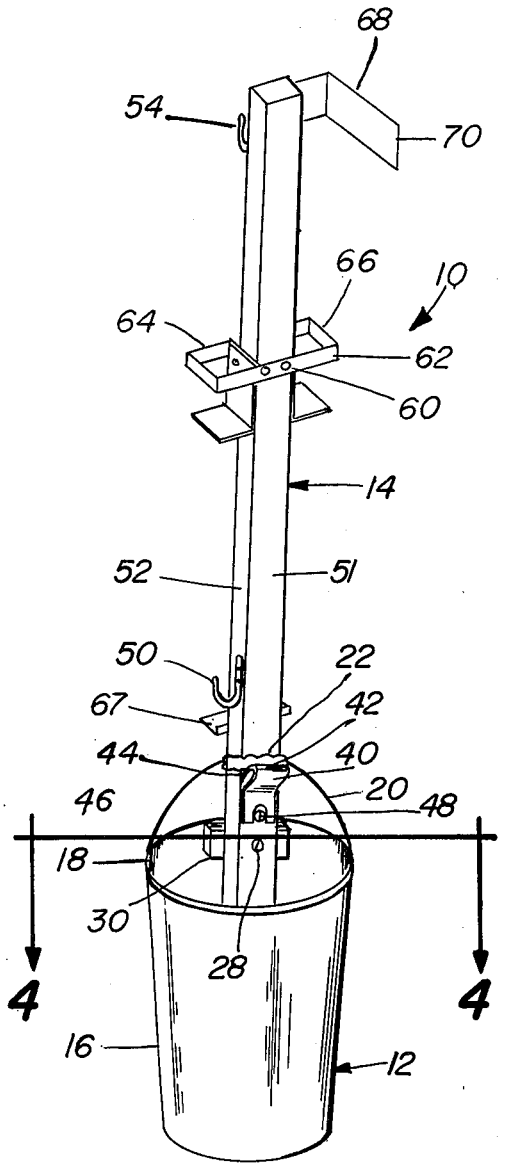
FIG. 1 is a perspective front view of a container and service tower combination constructed in accordance with the principles of the present invention.
Figure 2:
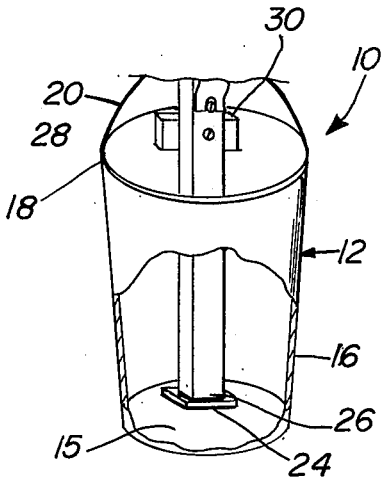
FIG. 2 is a fragmentary, partially sectioned view of the container and service tower illustrated in FIG. 1 of the drawings.
Figure 4:
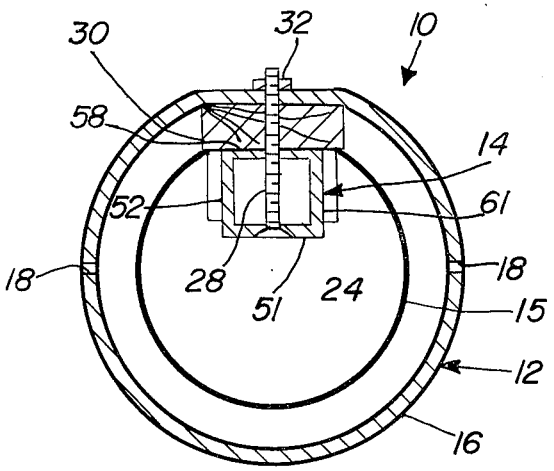
FIG. 4 is a cross-sectional view of the container and service tower taken along Line 4—4 of FIG 1.

Referring now to the drawings and, in particular, to FIGS. 1 and 2 wherein there is illustrated one example of the present invention in the form of an apparatus 10 for storing a cleaning fluid and for conveniently mounting a plurality of articles used in conjunction with the cleaning operation. The apparatus 10 comprises a container 12 and a service tower in the form of a support post 14 which is attached to the container 12 in a manner which will be described hereinafter. As can best be seen in FIG. 1, the container 12 is of a cylindrical shape having a side wall 16 which is integral with a bottom wall 15. The side wall 16 of the container 12 is provided with a pair of diametrically opposed apertures 18 which snap-lockingly receive the opposite ends of a handle 20. The handle ends are so received by the apertures 18 that the handle 20 may pivot with respect to the container 12 in the conventional manner. The upper end of the container handle 20 has a wooden portion 22 which facilitates the gripping of the handle 20 to lift the container 12. The bottom 15 of the container 12 is provided with a foam rubber material that defines a cushion 24 which resiliently and stably supports the lower end 26 of the post 14. The cushion 24 is preferably made of a water-resistant material, as the container 12 is adapted to be filled with water and cleaning fluid so as to provide a convenient source of soapy water to facilitate the cleaning of any of the aforementioned house-hold items, including one's automobile. An intermediate portion of the support post 14 is apertured to receive a threaded fastener 28 which extends through the support post 14, a spacer 30 and the side wall 16 of the container 12. A suitable nut 32 engages the threaded end of the fastener 28 so as to secure the post 14 to the container 12. The spacer 30 provides the dual function of adding strength to the side wall 16 of the container 12 while securely mounting the support post 14 to the container 12. It should be noted that the thickness of the spacer 30 is greater than the distance between the lower edge of the side wall 16 and the lower end 26 of the support post 14. This provides for a slight inclination of the upright post 14 with respect to the vertical axis whereby the post 14 is inclined toward the center of the container 12. This provides for the proper location of the center of gravity of the support post 14 when the same is carrying the aforementioned articles, as will be described hereinafter. This adds to the stability of the apparatus 10 when the same is in use.

The support post 14 further comprises an attachment clip 40 that has an upper curved end 42 that terminates in abutment with the side wall of the support post 14 to define a wedge-shaped groove 44 thereinbetween. The lower end of the clip 40 has a U-shaped slot 46 sized such that the slot 46 is received behind the head of a threaded fastener 48 which, in turn, is threadingly engaged into the side wall 51 of the support post 14. As can best be seen in FIGS. 1 and 2 of the drawings, the clip 40 is attached to the support post 14 at a distance from the lower end 26 of the support post 14 so as to accommodate the reception of the wooden portion 22 of the handle 20 within the wedge-shaped groove 44. The distance between the wedge-shaped groove 44 and the lower end 26 of the support post 14 is such that the handle 20 is slightly stretched as it passes over the top of the curved portion 42 of the clip 40 and is snap-lockingly received within the wedge-shaped groove 44. This arrangement insures the stability of the container 12 when the same is filled with water and the apparatus 10 is carried in the manner which will be described hereinafter.

The side walls of the support post 14 mount a plurality of article-supporting devices including a U-shaped attachment hook 50 mounted on the wall 52 of the support post 14, while a second support hook 54 is mounted on the adjacent wall 58 (FIG. 3) which is 90° removed from the wall 52.

Figure 3:
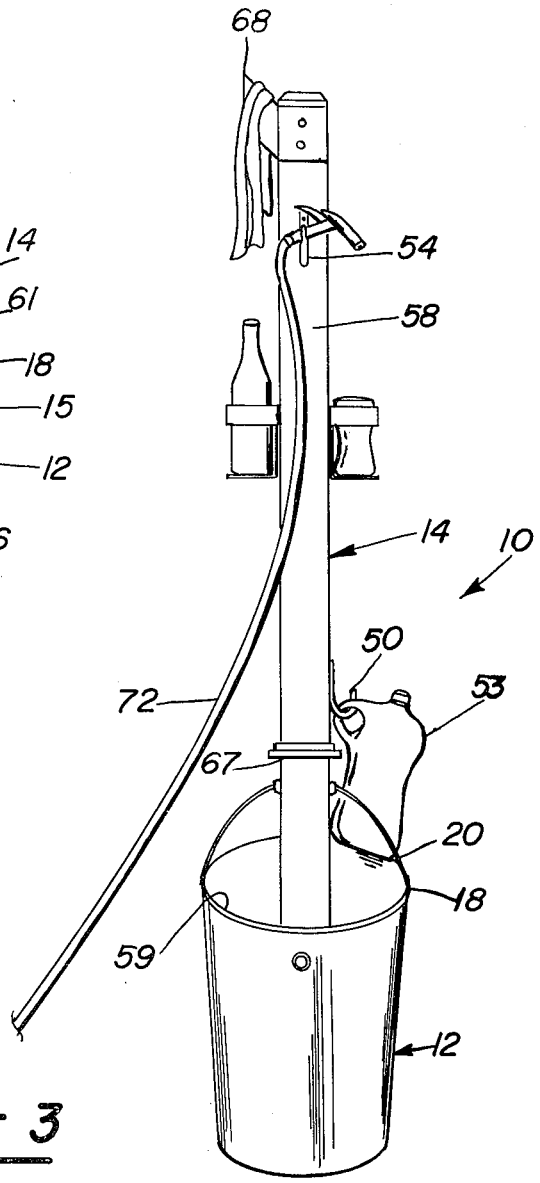
FIG. 3 is a perspective rear view of the container and service tower illustrated in FIG. 1 of the drawings.

The hook 50 is adapted to receive the handle of a package 53 of the type within which cleaning fluid is commercially sold. Preferably, the hook is designed and attached to the side wall 52 in such a manner that the cleaning bottle handle is received within the hook 50, while the base of the bottle is supported on the top edge 59 of the container 12 (FIG. 3).

The side wall 51 of the support post 14 is provided with a pair of spaced apertures which receive rivots or other suitable fastening members 60 that extend through a lateral member 62 of a pair of baskets 64 and 66 that are respectively mounted adjacent the opposite side walls 52 and 61. Support baskets 64 and 66 are adapted to receive and support suitable items, such as cleansing powder and the like. The support wall 58 is provided with a tray 67 at a position adjacent the hook 50 and is adapted to support other useful items, such as a sponge or the like.

The upper end of the support post 14 mounts an L-shaped bracket 68 which has particular use in providing a means for supporting the upper end of a broom or brush handle, while its lower end is positioned within the container 12. The extended end 70 of the L-shaped bracket 68 may function to simply support a towel, chamois or similar cloth which would be required when washing windows, automobiles and the like.

It can thus be seen that applicant's apparatus 10 provides a unique and novel combination of a container and support post which provides the user with a simple means for carrying soapy water and all of the other articles and paraphernalia necessary for performing a washing operation. The entire apparatus 10 may be positioned in a close proximity to the vehicle or window which is to be washed, while all of the articles are within an easy reach of the user. As can best be seen in FIG. 3, the hook 54 provides a very simple means for the mounting of a garden hose 72 so that the same may be simply grasped and utilized without inconvenience to the user. When the user is washing a variety of articles, such as windows in a home, he may move from window to window carrying all the necessary articles to perform the washing operation in a simple and convenient manner.

It should be understood by those skilled in the art of comparable apparatuses that other forms of applicant's invention may be had, all coming within the spirit of the invention and the scope of the appended claim.

What is claimed is as follows:

1. An apparatus for storing a cleaning fluid and a plurality of articles and related paraphernalia for use in conjunction with the cleaning fluid, said apparatus comprising:

a container having a bottom and a circular side wall, said container being opened at its top;

an upright support post;

first means carried within the interior of said container at the bottom thereof for supporting the lower end of said support post at a location adjacent to said wall;

second means for fastening said support post to said container wall at the upper portion of said wall;

spacer means associated with said second means between said container and said support post for slightly inclining said support post toward the center of said container for stabilizing said support post when it is carried by said container;

handle means pivotally carried by said container for lifting said container;

third fastening means carried by said support post for snap-lockingly receiving said handle means to secure said container to said support post and to provide stability for said container when said support post is lifted; and a plurality of holding means mounted to said support post, each of said holding means being adapted to carry and support one of a plurality of said articles and paraphernalia.

* * * * *